US006889392B1

(12) United States Patent
Karnopp et al.

(10) Patent No.: US 6,889,392 B1
(45) Date of Patent: May 10, 2005

(54) BARIATRIC TOILET SEAT SUPPORT APPARATUS

(75) Inventors: Gordon J. Karnopp, Green Bay, WI (US); David F. Burkart, Little Suamico, WI (US)

(73) Assignee: DB Industries LLC, Little Suamico, WI (US)

( * ) Notice: Subject to any disclaimer, the term of this patent is extended or adjusted under 35 U.S.C. 154(b) by 0 days.

(21) Appl. No.: 10/454,869

(22) Filed: Jun. 5, 2003

(51) Int. Cl.[7] ..... E03D 11/00
(52) U.S. Cl. ..... 4/254; 4/239
(58) Field of Search ..... 4/254, 239, 246.1, 4/246.4, 246.5; 297/452.18, 338; 248/346.01, 248/188.1

(56) References Cited

U.S. PATENT DOCUMENTS 2,903,714 A * 9/1959 Grondona ..... 4/254
3,047,884 A * 8/1962 Grondona ..... 4/254
5,150,480 A 9/1992 Schmucki
5,210,883 A 5/1993 Weber et al.
5,289,596 A 3/1994 Rose et al.
5,309,583 A * 5/1994 White et al. ..... 4/667
5,341,517 A 8/1994 Bly
5,933,877 A * 8/1999 Wu ..... 4/254
6,000,068 A 12/1999 Chavis
6,199,228 B1 * 3/2001 Kallweit ..... 4/667
6,256,800 B1 * 7/2001 Isbit ..... 4/254
6,324,705 B1 12/2001 Zephier

* cited by examiner

*Primary Examiner*—Khoa D. Huynh
(74) *Attorney, Agent, or Firm*—Andrus, Sceales, Starke & Sawall, LLP

(57) ABSTRACT

A bariatric toilet seat support apparatus for a conventional toilet is disclosed herein. The bariatric toilet seat support apparatus is designed to be placed under a toilet seat such that when an individual uses the toilet seat the weight of the individual is transferred from the toilet seat to the support apparatus of the current invention, avoiding distribution of weight to the toilet itself. The bariatric toilet seat support apparatus of the current invention may be used with floor mounted or wall mounted toilets. It is designed to prevent wall mounted toilets from breaking off the wall under the weight of an individual and also to prevent floor mounted toilets from collapsing under the weight of an individual.

25 Claims, 4 Drawing Sheets

BARIATRIC TOILET SEAT SUPPORT APPARATUS

BACKGROUND OF THE INVENTION

The current invention relates to toilet supports, more particularly to toilet seat supports for floor or wall mounted toilets, and most particularly to toilet seat supports for bariatric individuals using floor mounted or wall mounted toilets.

Toilets manufactured in the United States are currently rated to support approximately 300 lbs. However, the population of this country is getting larger and larger with each passing year.

The vitreous china or porcelain that both wall mounted and floor mounted toilets are constructed of is incapable of supporting bariatric (i.e. overweight) individuals. Conventional toilets have a seat designed to receive the weight of an individual using the toilet. The weight of an individual is distributed onto the toilet when in use. When a bariatric individual using a toilet exceeds the toilet support capacity, significant problems may occur.

Many hospitals and other institutions have had problems with wall mounted toilets breaking off the wall due to the weight of bariatric individuals. Further, floor mounted toilets have been known to collapse under the weight of bariatric individuals. Such individuals may receive serious injuries when a toilet collapses beneath them, including, lacerations to the buttocks, thighs, and back. Further, the discomfort and embarrassment of toilet collapse victims should not be underestimated.

Accordingly, there is a need for a support apparatus that will support the toilet seat of a toilet and relieve the toilet from the weight of an individual.

SUMMARY OF THE INVENTION

The current invention provides a bariatric toilet seat support apparatus for use with a floor mounted or wall mounted toilet. Conventional toilets have a seat for receiving the body of a user. The seat transfers the user's weight to the toilet. The bariatric toilet seat support apparatus of the current invention comprises a weight distributing frame positionable on a floor surface and a pair of toilet seat support members attached to the frame. The toilet seat support members are suitable to be positioned under the toilet seat to receive the weight of the user so that the weight of the user is distributed onto the weight distributing frame. Thus, the weight of the individual is relieved from the toilet.

In one embodiment of the invention, the bariatric toilet seat support apparatus of the current invention has base members removably attached to the frame for engaging the floor surface. Preferably, the base members have a means for adjusting the height of the support apparatus, a means for leveling the support apparatus, and a non-slip bottom surface. The means for adjusting the height of the support apparatus is adjustable to position the seat support members at a proper height to receive the weight of a user.

In another embodiment, the bariatric toilet seat support apparatus includes a pair of adjustable wall locator members engageable with a wall proximate to the toilet. The wall locator members are adjustable to position the seat support members at a proper location between the toilet seat and the toilet to receive the weight of the user.

In another embodiment, the bariatric toilet seat support apparatus of the current invention includes both the aforementioned adjustable base members and the aforementioned adjustable wall locator members. In this embodiment, both the adjustable base members and the adjustable wall locator members adjust to position the seat support members at the proper location related to the toilet to receive the weight of a user when the bariatric seat support apparatus of the current invention is in use.

The seat support members of the bariatric toilet seat support apparatus of the current invention have a thickness such that the support members may be placed between a toilet seat and a toilet bowl such that the toilet seat rests substantially along the support members. The weight distributing frame is fixedly attached along the outside edges of the bottom surface of the respective toilet seat support members. Thus, the toilet seat support members of the bariatric toilet seat support apparatus of the current invention may be placed between the toilet seat and a toilet bowl such that the toilet seat rests in a substantially parallel manner on the top surfaces of the respective support members. Further, with the embodiments including the adjustable base members and the adjustable wall locator members, the position of the seat support members will be advantageously positioned under the toilet seat to receive the weight of the user so that the weight is distributed onto the frame and relieved from the toilet.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
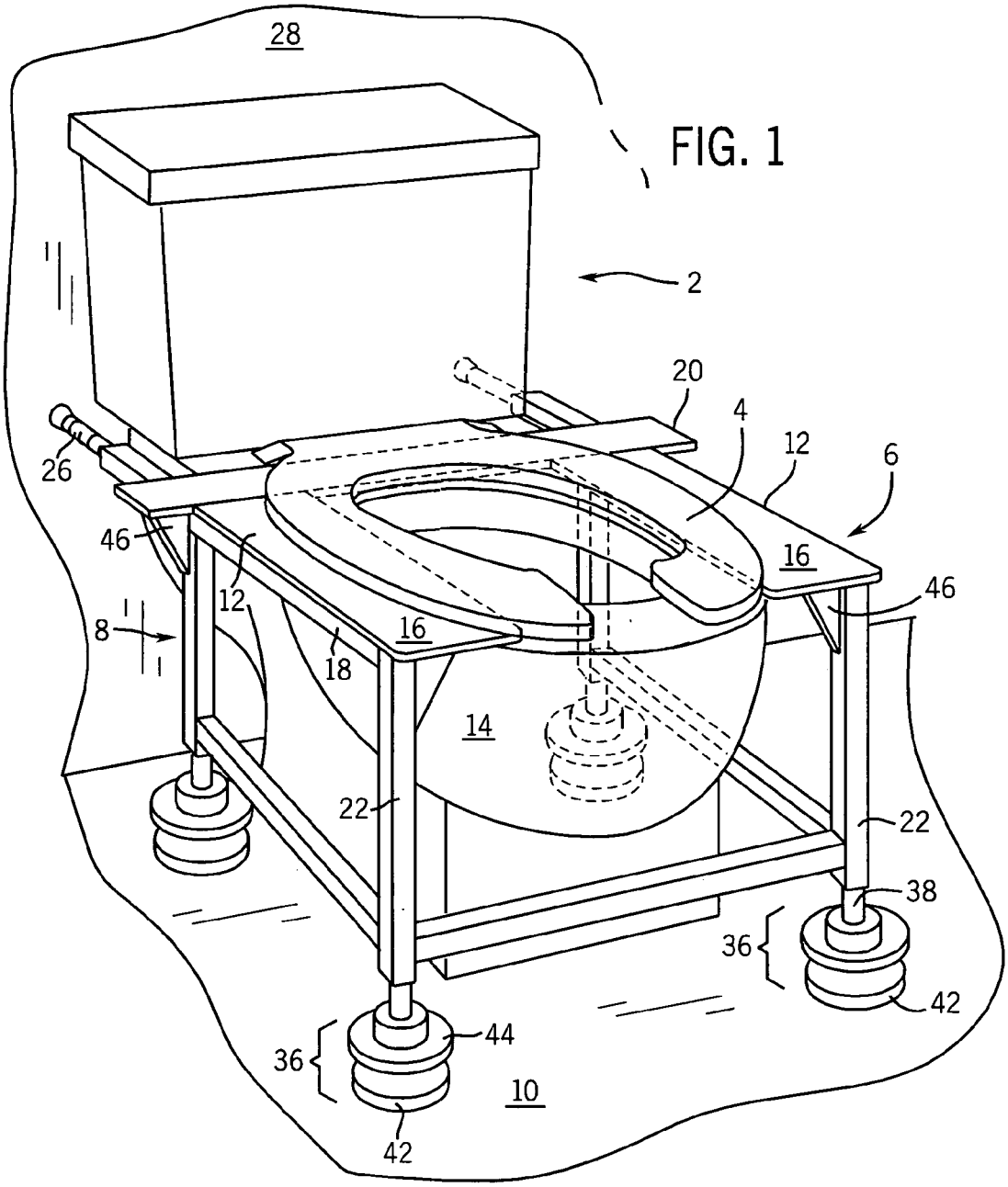
FIG. 1 is a perspective view of the new bariatric toilet support apparatus according to the current invention shown in use with a floor mounted toilet.
Figure 2:
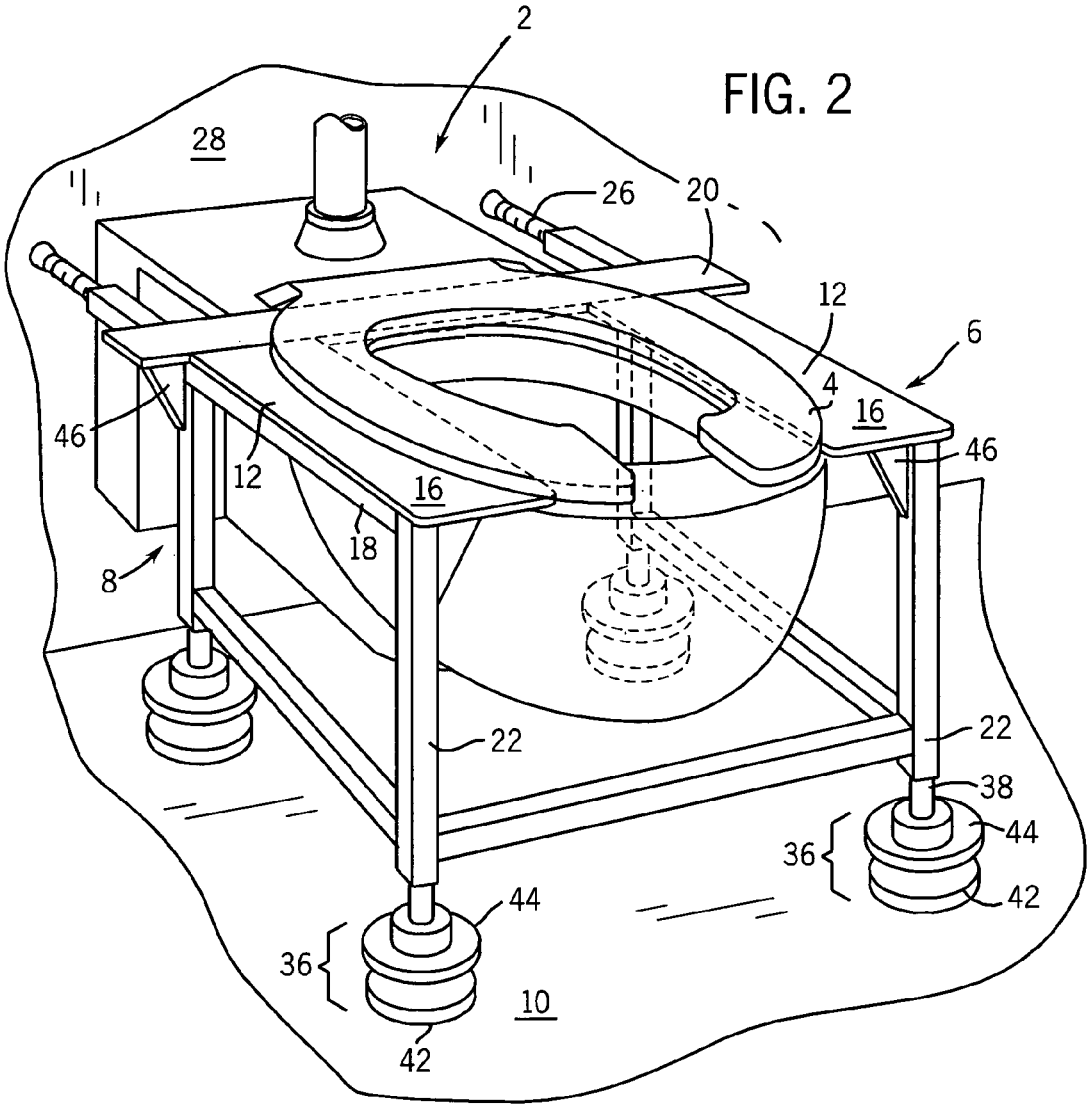
FIG. 2 is a perspective view of the new bariatric toilet seat support apparatus of the current invention shown in use with a wall mounted toilet.

With reference now to the drawings, FIG. 1 shows the bariatric toilet seat support apparatus 6 in use with a floor mounted toilet 2. Similarly, FIG. 2 shows the bariatric toilet seat support apparatus 6 in use with a wall mounted toilet 2. Referring now to both FIG. 1 and FIG. 2, the bariatric toilet seat support apparatus of the current invention is designed for use with any conventional toilet 2. The toilet 2 may be either floor mounted, as demonstrated in FIG. 1, or wall mounted, as demonstrated in FIG. 2. The toilet 2 has a seat 4. The seat 4 receives a portion of the body of a user, thus the seat receives the weight of the user.

The bariatric toilet seat support apparatus 6 is comprised of a weight distributing frame 8 positionable on a floor surface 10, and a pair of toilet seat support members 12 attached to the frame 8. The toilet seat support members 12 are attached to the frame 8 preferably by welding, but may be attached using any other conventional means.

Preferably, the bariatric toilet seat support apparatus 6 is constructed of stainless steel. However, one of skill in the art will recognize that other material may be used to construct the apparatus. For example, and without limitation, the bariatric toilet seat support apparatus may be constructed of aluminum, carbon fiber, titanium or similar weight-bearing materials, or a combination thereof.

Figure 3:
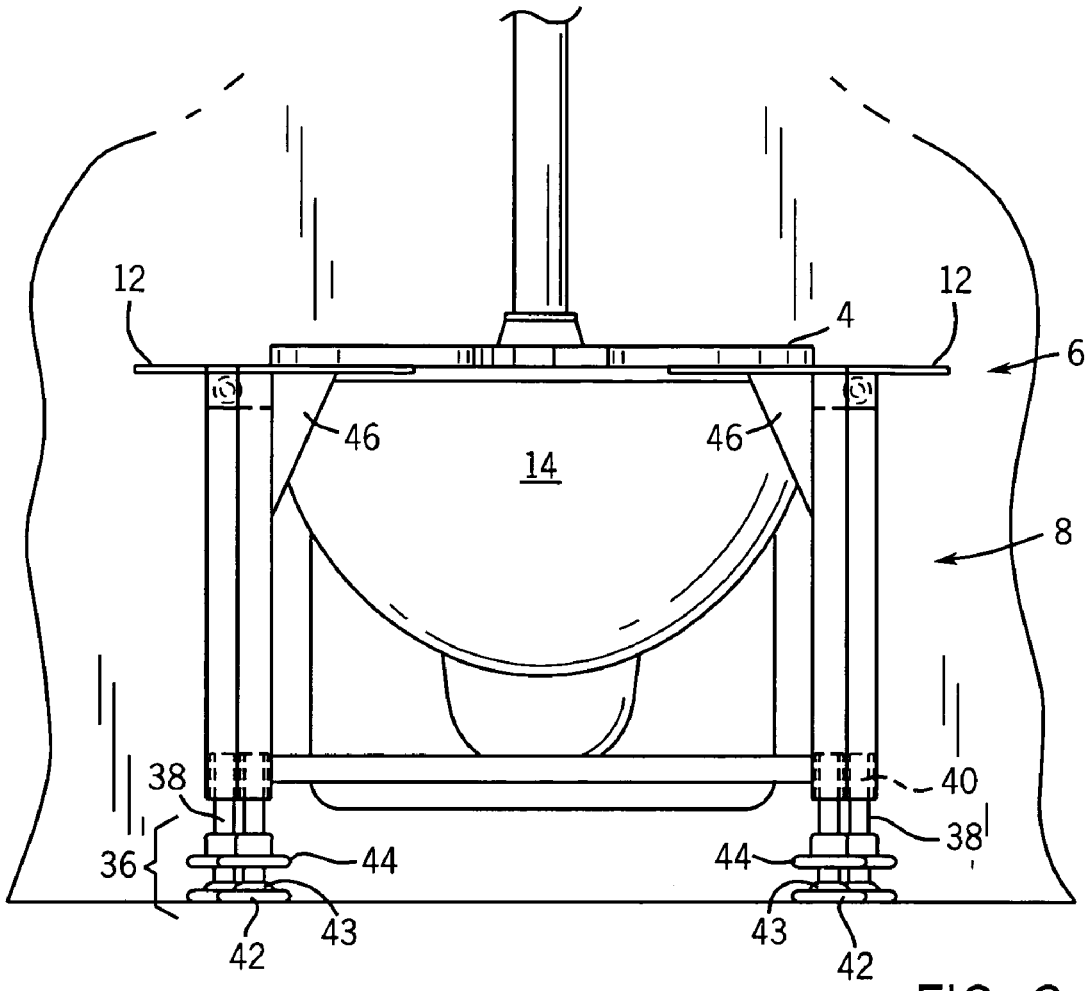
FIG. 3 is a front view of the present invention.
Figure 5:
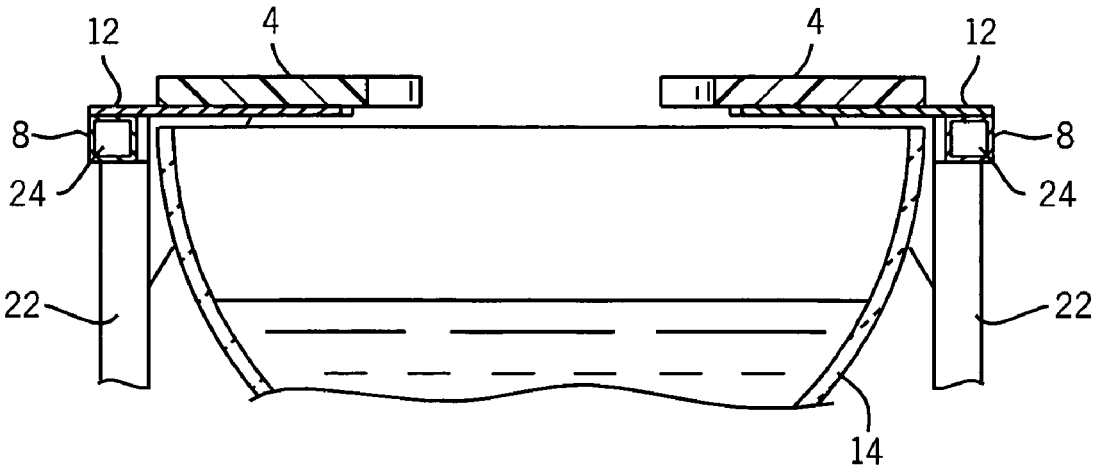
FIG. 5 is a sectional view of the present invention taken along line 5—5 of FIG. 4.
Figure 4:
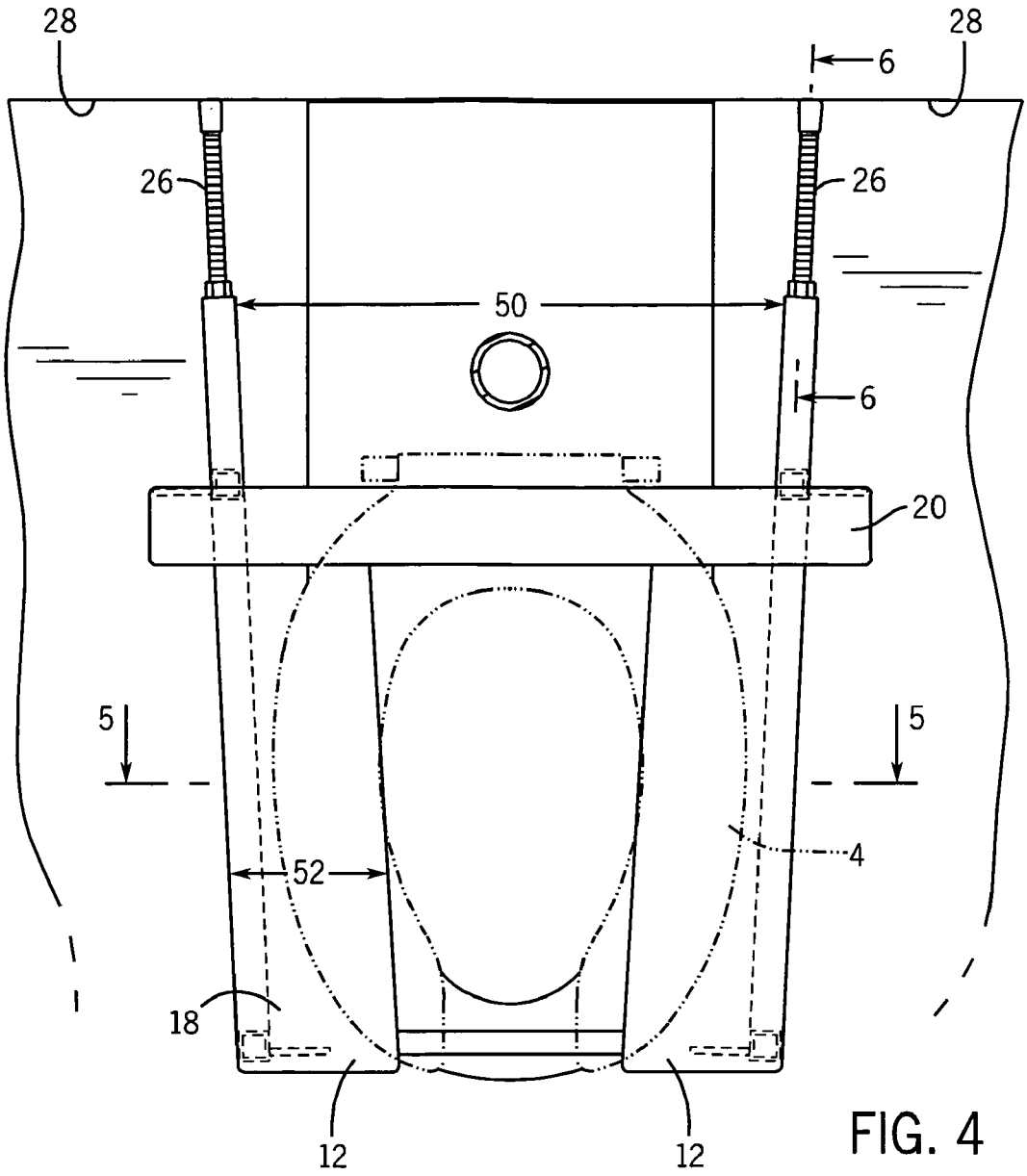
FIG. 4 is a top view of the present invention.

The toilet seat support members 12 are of a thickness such that the support members 12 may be placed between the toilet seat 4 and a toilet bowl 14 of a toilet 2. FIGS. 3, 4 and 5, in addition to FIGS. 1 and 2, demonstrate this arrangement. Although FIGS. 3, 4 and 5 demonstrate the support apparatus 6 in conjunction with a wall mounted toilet, it is understood that the apparatus may be used in the same manner with a floor mounted toilet. The bariatric toilet seat support apparatus 6 is designed such that the toilet seat 4 rests on top surfaces 16 of the support members 12. Often toilet seats 4 have support knobs (not shown) for engaging the toilet bowl 14. If such support knobs exist on the toilet seats, the current invention is designed such that the knobs rest on the top surfaces 16 of the support members 12. Thus, the support members 12 are suitable to be positioned under the toilet seat 4 to receive the weight of the user so that the weight is distributed onto the frame 8 and relieved from the toilet bowl 14.

With reference now to FIGS. 1, 2, 4 and 6, the weight distributing frame 8 is preferably constructed with a pair of support member braces 18. The support member braces 18 are attached in a parallel fashion along the outside edges of the bottom surfaces of the respective toilet seat support members 12. The weight distributing frame 8 further comprises a back plate brace 20 attached to and extending between the support member braces 18 and located perpendicular to the back edges of the support members 12. The weight distributing frame further comprises at least four post members 22 attached to the support member braces 18 and adapted to engage the floor surface 10. Preferably, the weight distributing frame 8 includes angled braces 46 attached to post members 22. A first pair of angle braces 46 is attached to the front post members 22 and to the lower surfaces of the support members 12. The second pair of angle braces 46 is attached to the back post members 22 and the lower surface of the back plate brace 20. In this manner, the angle braces 46 provide additional support to the support members 12 and to add overall strength to the support apparatus 6. The frame is constructed preferably by welding, however, the frame may be assembled using other conventional means which will accomplish the weight distributing function of the frame 8.

Figure 6:
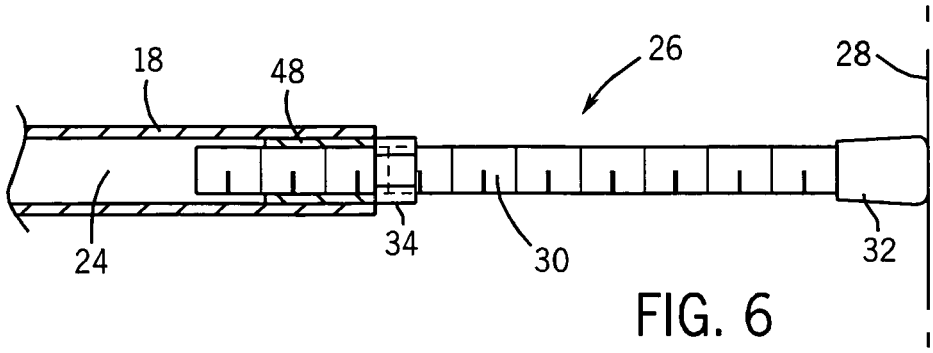
FIG. 6 is a sectional view of a support member of the present invention taken along line 6 of FIG. 4.

Referring now to FIGS. 4 and 6, in the preferred embodiment of the current invention, the support member braces 18 have a bore 24 therethrough. The bore is adapted to receive adjustable wall locator members 26. The adjustable wall locator members 26 are displaced in the bore 24 of the support member braces 18. The adjustable wall locator members 26 are adjusted to engage a wall 28 proximate to the toilet. The wall locator members 26 are further adjustable to position the seat support members 12 at a proper location so that the seat support members 12 are properly positioned to engage the toilet seat 4 and receive the weight of the user. As demonstrated in FIGS. 4 and 6, the adjustable wall locator members 26 are preferably constructed of a threaded rod 30 having a rubber stopper 32 attached to the end of the rod adapted to engage a wall 28. The bore 24 most preferably contains a stainless steel nut 48 adapted to engage the threaded rod 30. Alternatively, the threaded rod 30 may directly engage the bore 24. The adjustable wall locator members preferably further include a locking nut 34 to maintain the proper position of the support apparatus 6 when in use. It will be appreciated by one of skill in the art that other embodiments of adjustable wall locator members exist, including slidably adjustable wall locator members, locking lever adjustable wall locator members, and the like.

Referring now to FIGS. 1, 2 and 3, the bariatric toilet seat support apparatus 6 of the current invention may further comprise adjustable base members 36 adapted to engage the floor surface 10. The base members 36 may be removably attached to the frame 8. Preferably, the base members 36 are integral removably threaded to the post members 22 of the weight distributing frame 8. The adjustable base members 36 comprise a means for adjusting the height of the support frame. In the preferred embodiment, the means for adjusting the height of the support frame 8 comprises a threaded rod 38 adapted to engage a bore 40 in the respective post members 22. The bore 40 most preferably contains a stainless steel nut (not shown) for engaging the threaded rod 38. Alternatively, the threaded rod 38 may directly engage the bore 40.

The adjustable base members 36 further comprise a floor member 42 adapted to engage the floor surface 10. The floor member has a non-slip bottom surface, preferably of neoprene. The adjustable base members further comprise a means for leveling coupled to the floor member 42 and engaging the adjusting means. The leveling means is adapted to adjust for uneven floors. Preferably, the leveling means comprises the threaded rod 38 coupled to the floor member 42 by a swivel bolt 43. In the most preferred embodiment, the adjustable base members are nylon-based swivel leveling mounts available from McMaster-Carr, Part No. 61045K47. The most preferred embodiment further comprises plastic recessed clamping knobs 44 to lock the adjustable base members 36 in place. The plastic recessed clamping knobs 44 are available from McMaster-Carr, Part No. 61905K33.

Referring to FIGS. 1, 2 and 4, it is recognized by those with skill in the art that conventional toilets vary their dimensions depending upon the manufacturer of the toilet. The bariatric toilet seat support apparatus 6 of the current invention is adapted for use on any conventional toilet. Preferably, the widest dimension of the toilet with which the bariatric toilet seat apparatus 6 is to be used in conjunction with is determined. The distance 50 between support member braces 18 corresponds to this widest dimension of a toilet. Correspondingly, as distance 50 narrows, distance 52, which corresponds to the width of the seat support member 12, will narrow as well. It will be recognized by one skilled in the art that the dimensions of the frame 8 will vary with the particular toilet that the bariatric toilet seat support apparatus 6 is to be used in conjunction with. Accordingly, it is contemplated that the overall dimensions, i.e., height and width of the apparatus 6, may be varied according to the particular toilet that the bariatric toilet seat support apparatus 6 of the current invention is to be used in conjunction with. Further, the overall dimensions may be varied to accord with applicable regulatory requirements.

Referring now to FIGS. 1–6, it will be recognized by one of skill in the art that the bariatric toilet seat support apparatus 6 of the current invention is capable of supporting a toilet seat 4 such that when the toilet seat receives the weight of a user, the weight is distributed onto the frame 8 of the support apparatus 6 and the weight is relieved from the toilet bowl 14 of the toilet 2. It will be further appreciated by one of skill in the art that the addition of adjustable base members and adjustable wall locator members aid in positioning the seat support members 12 between the toilet seat 4 and the toilet bowl 14 such that the toilet seat rests in a substantially parallel manner on the top surfaces of the respective support members 12.

It should be further apparent to those skilled in the art that the bariatric toilet seat support apparatus of the current invention, as described herein, contains several features, and that variations to the preferred embodiment disclosed herein may be made which embody only some of the features disclosed herein. For example, it may be desirable to construct the apparatus having a frame of a different configuration but which ultimately achieves the object of relieving the weight from the toilet 2. It may be further desirable to construct a bariatric toilet seat support apparatus in accordance with the current invention without adjustable base members 36, or with base members 36 fixedly attached to the frame 8. Even further, it may be desirable to construct a bariatric toilet seat support apparatus without adjustable wall locator members 26.

Various other combinations, and modifications or alternatives, may also be apparent to those skilled in the art. Such various alternatives and other embodiments are contemplated as being within the scope of the following claims, which particularly point out and distinctly claim the subject matter regarded as the invention.

We claim:

1. A bariatric toilet seat support apparatus for use with a floor mounted or wall mounted toilet, said toilet having a seat for receiving the weight of a user, said support apparatus comprising:

a pair of toilet seat support members having a top surface, a bottom surface, an outside edge, an inside edge, a front edge, a back edge and said toilet seat support members of a thickness such that said support members may be placed between a toilet seat and a toilet bowl of a toilet such that said toilet seat rests on said top surfaces of the respective support members;

a weight distributing frame positionable on a floor surface, said frame comprising:

a pair of support member braces having a bore therethrough and attached in a parallel fashion along said outside edges of said bottom surfaces of the respective support members;

a back plate brace attached to and extended between said pair of support member braces and located perpendicularly adjacent to said back edges of said seat support members; and at least four post members attached to said support member braces and adapted to engage the floor surface;

adjustable base members integral to said post members of said weight distributing frame for engaging said floor surface, each of said adjustable base members comprising:

a means for adjusting the height of said support frame;

a floor member adapted to engage said floor surface, said floor member having a non-slip bottom surface;

a means for leveling coupled to said floor member and engaging said adjusting means;

a pair of adjustable wall locator members displaced in said bore of said support member braces engageable with a wall proximate to the toilet; and wherein said adjustable base members and said wall locator members are adjustable to position said seat support members between said toilet seat and toilet bowl such that said toilet seat rests in a substantially parallel manner on said top surfaces of the respective support members and such that the support members receive the weight of the user, said weight being distributed onto said frame and relieving the weight from the toilet.

2. The bariatric toilet seat support apparatus of claim 1 wherein said toilet seat support members are parallelepiped.

3. The bariatric toilet seat support apparatus of claim 1 wherein said means for adjusting the height of said support apparatus comprises a threaded rod adapted to engage a bore in said post members.

4. The bariatric toilet seat support apparatus of claim 1 wherein said means for leveling comprises said adjusting means coupled to said floor member by a swivel bolt, and wherein said leveling means adjusts for uneven floors.

5. The bariatric toilet seat support apparatus of claim 1 wherein at least two of said post members of said weight distributing frame are arranged beneath said front edge of the respective toilet seat support members.

6. The bariatric toilet seat support apparatus of claim 5 wherein said weight distributing frame further comprises a front brace extending between said two post members arranged beneath said front edges of the respective support members.

7. The bariatric toilet seat support apparatus of claim 1 wherein said adjustable wall locator members comprise a threaded rod adapted to engage said bore of said support member braces.

8. A bariatric toilet seat support apparatus for use with a floor mounted or wall mounted toilet, said toilet having a seat for receiving a portion of the body of a user, said support apparatus comprising:

a weight distributing frame positionable on a floor surface, said frame comprising:

at least four vertical post members, at least two of said post members comprising back post members and at least two of said post members comprising front post members;

a brace member connecting said two front post members; and a pair of support member braces connecting said back post members to said front post members;

a pair of toilet seat support members attached in a parallel fashion along the length of said support member braces, said support members suitable to be positioned under the toilet seat to receive a weight of the user so that the weight of the user is distributed onto said frame and relieved from the toilet, wherein the apparatus prevents the collapse of wall-mounted and floor-mounted toilets due to the weight of the user, said apparatus further comprising a pair of adjustable wall locator members engageable with a wall proximate to the toilet, wherein said wall locator members are adjustable to position said seat support members at a proper location to receive a weight of the user.

9. The bariatric toilet seat support apparatus of claim 8 further comprising base members removably attached to said frame.

10. The bariatric toilet seat support apparatus of claim 9 wherein each of said base members comprises an adjusting means for adjusting the height of said support apparatus wherein the means for adjusting the height of said support apparatus is adjustable to position said support members at a proper height to receive the weight of a user.

11. The bariatric toilet seat support apparatus of claim 10 wherein each of said base members further comprises a floor member with a non-slip bottom surface for placement on the floor surface, said floor member adapted to engage said means for adjusting the height of said support apparatus.

12. The bariatric toilet seat support apparatus of claim 11 wherein each of said base members further comprises a means for leveling, said means for leveling coupled to said floor member and engaging said height adjusting means, wherein the means for adjusting the height of said support apparatus is adjustable to position said support members at a proper height to receive the weight of a user.

13. The bariatric toilet seat support apparatus of claim 8 wherein said adjustable wall locator members are removeably threaded to said weight distributing frame.

14. The bariatric toilet seat support apparatus of claim 8 wherein said toilet seat support members are of a thickness such that said support members are placed between said toilet seat and a toilet bowl such that said toilet seat is adapted to rest substantially along said support members.

15. The bariatric toilet seat support apparatus of claim 14 wherein said toilet seat support members are parallelepiped.

16. The bariatric toilet seat support apparatus of claim 8 wherein said weight distribution frame is fixedly attached along outside edges of the bottom surface of the respective toilet seat support members.

17. The bariatric toilet seat support apparatus of claim 14 wherein said support members are placed between a toilet seat and a toilet bowl such that said toilet seat is adapted to rest in a substantially parallel manner on said top surfaces of the respective support members.

18. The bariatric toilet seat support apparatus of claim 14 further comprising base members moveably attached to said frame, wherein the height of said base members is adjustable to position said seat support members between said toilet seat and said toilet bowl such that said toilet seat is adapted to rest substantially parallel to said support members.

19. The bariatric toilet seat support apparatus of claim 8 where said base members comprise:

a means for adjusting the height of said support apparatus;

a floor member with a non-slip bottom surface for being placed in contact with the floor surface; and a means for leveling, coupled to said floor member and engaging said adjusting means wherein said leveling means adjusts for uneven floors.

20. A bariatric seat support apparatus for use with a floor-mounted or wall-mounted toilet, said toilet having a seat for receiving a user, said support apparatus comprising:

a weight distributing frame positionable on a floor surface, said frame comprising:

at least four vertical post members, wherein at least two of said post-members comprise back post members and at least two of said post members comprise front post members; and a brace member connecting said at least two front post members;

a pair of support member braces connecting said back post members to said front post members;

a pair of toilet seat support members attached in a parallel fashion along said support member braces under the toilet seat to receive a weight of the user so that the weight is distributed onto said frame and relieved from the toilet; and base members removably attached to said frame for engaging the floor surface; wherein the base members include a non-slip bottom surface for being placed on the floor surface, wherein said apparatus prevents the collapse of wall mounted or floor mounted toilets due to the weight of the user, wherein said base members comprise a height adjusting means for adjusting the height of said support apparatus, and wherein the height of said support apparatus is adjustable to position said seat support members between said toilet seat and said toilet bowl such that the toilet seat is adapted to rest substantially parallel to said support members, wherein said base member further comprise means for leveling coupled to floor members and engaging said height adjusting means, and wherein said means for leveling adjust for uneven floor surfaces.

21. The bariatric toilet seat support apparatus of claim 20 further comprising a pair of adjustable wall locator means engagable with a wall proximate to the toilet.

22. The bariatric toilet seat support apparatus of claim 21 wherein said adjustable wall locator means are removably threaded to said frame.

23. The bariatric toilet seat support apparatus of claim 21 wherein said wall locator means are adjustable to position said seat support members between said toilet seat and said toilet bowl.

24. The bariatric toilet seat support apparatus of claim 20 wherein said toilet seat support members comprise a top surface and a bottom surface wherein said toilet seat engages said top surface of said toilet seat support members and said weight distributing frame is fixedly attached to said bottom surface of said toilet seat support members.

25. The bariatric toilet seat support apparatus of claim 24 wherein said adjustable wall locator means are adjustable to position said seat support members between said toilet seat and said toilet bowl, and further wherein said height adjustment means is adjustable to position said seat support members between said toilet seat and said toilet bowl, such that said toilet seat rests substantially parallel to said support members.

* * * * *